US008855525B2

(12) United States Patent
Muto et al.

(10) Patent No.: US 8,855,525 B2
(45) Date of Patent: Oct. 7, 2014

(54) DEVELOPING APPARATUS, AND IMAGE FORMING APPARATUS

(75) Inventors: Kazufumi Muto, Abiko (JP); Jiro Kinokuni, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 418 days.

(21) Appl. No.: 13/109,176

(22) Filed: May 17, 2011

(65) Prior Publication Data

US 2011/0286768 A1 Nov. 24, 2011

(30) Foreign Application Priority Data

May 19, 2010 (JP) ..... 2010-115327

(51) Int. Cl.
*G03G 15/08* (2006.01)

(52) U.S. Cl.
CPC .... *G03G 15/0822* (2013.01); *G03G 2215/0822* (2013.01); *G03G 15/0808* (2013.01); *G03G 2215/0838* (2013.01)
USPC ..... 399/103

(58) Field of Classification Search
USPC ..... 399/103, 105, 106, 255, 256
See application file for complete search history.

(56) References Cited

U.S. PATENT DOCUMENTS

| | | | | |
|---|---|---|---|---|
| 6,266,501 | B1 * | 7/2001 | Mizuishi et al. | 399/106 |
| 6,463,242 | B1 | 10/2002 | Kojima et al. | |
| 6,512,903 | B2 * | 1/2003 | Chadani | 399/106 |
| 6,934,485 | B2 * | 8/2005 | Miyabe et al. | 399/90 |
| 7,529,509 | B2 | 5/2009 | Ito et al. | |
| 2006/0222412 | A1 | 10/2006 | Ito et al. | |

FOREIGN PATENT DOCUMENTS

| | | | |
|---|---|---|---|
| CN | 1841229 | A | 10/2006 |
| JP | 2001-75346 | A | 3/2001 |
| JP | 2002-236413 | A | 8/2002 |
| JP | 2004-252174 | A | 9/2004 |
| JP | 2006-139231 | A | 6/2006 |
| JP | 2001-249544 | A | 9/2010 |

OTHER PUBLICATIONS

Notification of the First Office Action dated Jul. 20, 2012, in Chinese Application No. 201110130116.3.
Notification of the Second Office Action dated Apr. 15, 2013, in Chinese Application No. 201110130116.3.

* cited by examiner

*Primary Examiner* — Gregory H Curran
(74) *Attorney, Agent, or Firm* — Fitzpatrick, Cella, Harper & Scinto

(57) ABSTRACT

A developing apparatus includes a first chamber for accommodating a developer, the first chamber being provided with a developer carrying member for carrying the developer; a second chamber communicated with the first chamber through communication openings provided at opposite end portions to establish a circulation path; a feeding member, provided in the second chamber, for feeding the developer in a feeding direction which is from one of the communication openings toward the other communication opening; a sealing portion for openably sealing the communication openings; a moving mechanism for opening the communication openings by moving the sealing portion; and a reverse feeding member for feeding the developer in a direction which is opposite the feeding direction.

7 Claims, 10 Drawing Sheets

(a) E-E (b) F-F

DEVELOPING APPARATUS, AND IMAGE FORMING APPARATUS

FIELD OF THE INVENTION AND RELATED ART

The present invention relates to a developing apparatus which has first and second chambers and is shipped from a manufacturer in such a condition that developer is kept sealed in the second chamber by keeping the openings of the partitioning wall between the first and second chambers remain sealed with sealing sheets. More specifically, it relates to a developing apparatus structure which can reduces a developing apparatus in the amount of load to which a developing apparatus driving motor is subjected when a brand-new developing apparatus is started up for the very first time.

Image forming apparatuses in which a developing apparatus or a process cartridge is removably mountable, and which forms an electrostatic latent image on its image forming member, develop the electrostatic latent image by the developing apparatus, into a toner image, that is, an image formed of toner, and transfer the toner image onto recording medium, have been widely in use (Japanese Laid-open Patent Application 2001-75346). It is customary that an image forming apparatus and a replacement developing apparatus are shipped from a manufacturer in such a condition that the startup developer, which is the first body of developer to be used by the developing apparatus, is kept sealed along with nitrogen gas or the like, in the developing apparatus to prevent the body of developer from coming into contact with ambient air, for the following reason. That is, if developer is left unattended while being left in contact with such ambient air that is high in temperature and humidity, the developer deteriorates by absorbing the humidity. With the developer deteriorated by the humidity, it is possible that right after a brand-new developing apparatus is started up, the startup developer in the developing apparatus will fail to perform at a preset level.

Japanese Laid-open Patent Application 2001-75346 discloses a developing apparatus, to which the output of the motor with which the image forming apparatus is provided is transmitted to the developing apparatus through a coupling, and in which the inputted output (rotational force) is transmitted to its developer conveying screw and development sleeve by way of its gear train.

Japanese Laid-open Patent Application 2002-236413 discloses a developing apparatus which contains a developer container in which the startup developer, that is, the developer which is to be used when the developing apparatus is used for the very first time, is kept sealed by a sealing sheet. In the case of this developing apparatus, the developer container is to be unsealed by manually peeling the sealing sheet from outside of the apparatus, right after the mounting of the developing apparatus into the main assembly of an image forming apparatus. As the sealing sheet is peeled away, the startup developer in the developer container is allowed to fall into the developing apparatus to fill the developing apparatus.

However, in a case where a developing apparatus is shipped from a manufacturer with its first and second chambers left empty, and then, the developing apparatus is filled with the startup developer left sealed in the developer container, when the developing apparatus is used for the very first time, a large space for the developer container is necessary in the developing apparatus. Thus, if a developing apparatus is small, it cannot contain a developer container which is satisfactory in developer capacity. On the other hand, in order for a developing apparatus to be afforded a space for a developer container which is satisfactory in developer capacity, the developing apparatus has to be large in size, which interferes with the effort to reduce an image forming apparatus in size.

Thus, Japanese Laid-open Patent Application 2004-252174 proposes a developing apparatus structured as follows: It has first and second chambers, and until the developing apparatus is used for the very first time, the startup developer is kept hermetically sealed by a necessary amount, in the second chamber. More specifically, the partitioning wall of the developing apparatus, with which the first and second chambers are partitioned from each other, is provided with two openings, which are in the end portions, one for one, in terms of the lengthwise direction of the developing apparatus, and the second chamber is kept hermetically sealed by sealing the two openings of the partitioning wall with a sealing sheet. In the case of this developing apparatus, the second chamber functions as the developer container for containing the startup developer, that is, the developer to be used when the developing apparatus is used for the very first time. Therefore, storing the startup developer in the developing apparatus in the developing apparatus disclosed in Japanese Laid-open Patent Application 2004-252174 by a satisfactory amount does not require the developing apparatus to be significantly larger than an ordinary developing apparatus.

In the case of the developing apparatus proposed in Japanese Laid-open Patent Application 2004-252174, when an image forming apparatus is operated for the very first time, or right after the developing apparatus in the image forming apparatus was replaced with a brand-new developing apparatus, the sealing sheet has to be manually pulled out from outside the image forming apparatus to fill the development chamber of the developing apparatus with the startup developer, that is, the developer kept hermetically sealed in the developing apparatus, before an image forming operation is started. Thus, it was proposed to automatically peel the sealing sheet away from the openings of the partitioning wall between the first and second chambers, with the use of a part of the rotational force transmitted to the developing apparatus from the main assembly of the image forming apparatus through the coupling and a gear train, as disclosed in Japanese Laid-open Patent Application 2001-75346.

The development apparatus structured as disclosed in Japanese Laid-open Patent Application 2004-252174 is smaller in the area of the sealing sheet, by which the sealing sheet is pasted to the edges of the openings, being therefore smaller in the amount of torque necessary to peel way the sealing sheet, than that in Japanese Laid-open Patent Application 2002-236413. However, when an experiment was carried out in which the sealing sheet of a developing apparatus structured like the developing apparatus disclosed in Japanese Laid-open Patent Application 2004-252174 is automatically peeled, the torque required of the motor for peeling the sheet increased when the sealing sheet was being peeled by being rolled up. Thus, the motor was overloaded while the sealing sheet was peeled.

Thus, the operation of the mechanism for automatically peeling the sheet was observed by making transparent a part of the external wall of the developing apparatus. The observation revealed that as the second developer conveyance screw continued to rotate in the second chamber while the openings (outlets) of the second chamber remained sealed with the sealing sheet, the body of developer in the second chamber reached the ceiling of the chamber, on the downstream side of the chamber. Then, as the second developer conveyance screw was rotated more, the portion of the body of developer, which was in the downstream end portion of the second chamber, was compacted because the sealing sheet has not been removed from the openings, and therefore, the downstream end portion of the second chamber did not have an outlet for developer. Consequently, the body of developer, which was in the downstream end portion of the second chamber increased in internal pressure, overloading thereby the developer conveyance screw.

SUMMARY OF THE INVENTION

Thus, the primary object of the present invention is to provide a developing apparatus which is structured so that the openings of the wall between the two chambers of the apparatus are kept sealed with sealing sheets when it is shipped from a manufacturer, and yet, does not overload the motor of the main assembly of the image forming apparatus when the sealing sheets are automatically peeled away by being rolled up.

According to an aspect of the present invention, there is provided a developing apparatus comprising a first chamber for accommodating a developer, said first chamber being provided with a developer carrying member for carrying the developer; a second chamber communicated with said first chamber through communication openings provided at opposite end portions to establish a circulation path; a feeding member, provided in said second chamber, for feeding the developer in a feeding direction which is from one of the communication openings toward the other communication opening; a sealing portion for openably sealing said communication openings; a moving mechanism for opening said communication openings by moving said sealing portion; and a reverse feeding member for feeding the developer in a direction which is opposite the feeding direction.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described in detail with reference to the appended drawings. The present invention is also applicable to developing apparatuses other than the one in the preferred embodiment of the present invention, as long as the second chamber of the developing apparatuses is provided with an additional developer conveyance screw, and the additional developer screw is opposite in developer conveyance direction from the second developer conveyance screw. That is, as long as the above-described requirement is met, the present invention is applicable to any developing apparatus even if the developing apparatus is partially or entirely different in structure from the developing apparatuses in the preferred embodiments.

The developing apparatus in accordance with the present invention is employable by an image forming apparatus regardless of the apparatus type. For example, it is employable by an image forming apparatus regardless of whether the apparatus is of the tandem-type or single drum type, and whether or not the apparatus is of the intermediary transfer type or direct transfer type. Further, the present invention is also applicable to image forming apparatuses other than the one in the preferred embodiment, for example, a printer, a copying machine, a facsimile machine, a multifunction image forming apparatus, etc., which are made up of one of the image forming apparatuses in the preferred embodiments, and additional devices, equipment, and frames.

Incidentally, the ordinary items of the developing apparatuses disclosed in Japanese Laid-open Patent Applications 2001-75346, 2002-236413, and 2004-252174 are not illustrated, and are not described.

<Image Forming Apparatus>

Figure 1:
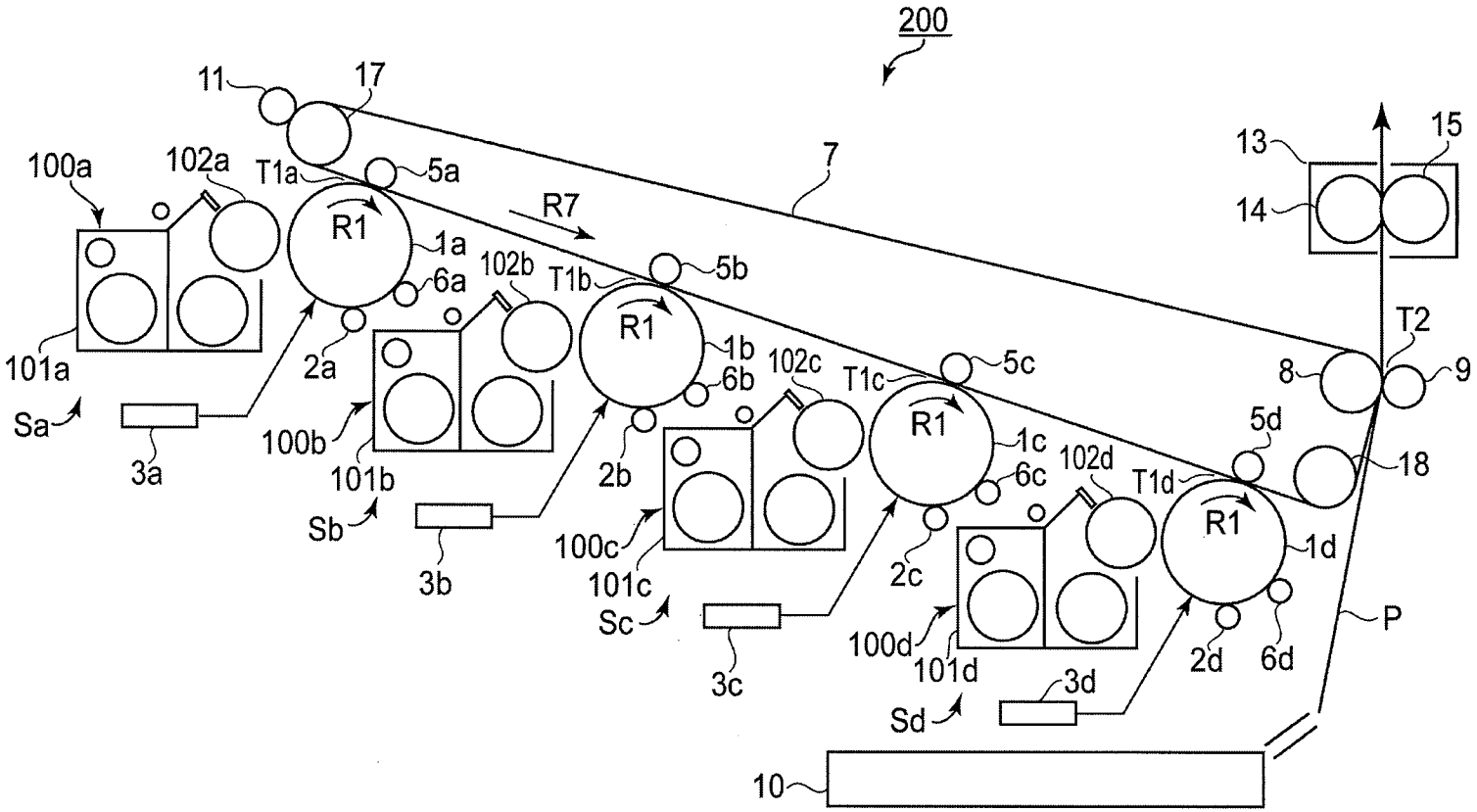
FIG. 1 is a schematic sectional view of the image forming apparatus in the first preferred embodiment of the present invention, and is for describing the structure of the apparatus.

FIG. 1 is a drawing for describing the general structure of a typical image forming apparatus. Referring to FIG. 1, an image forming apparatus 200 is a full-color printer. It is of the so-called tandem-type, and also, of the so-called intermediary transfer type. That is, it has: an intermediary transfer belt 7; and image forming portions Sa, Sb, Sc and Sd, which are for forming yellow, magenta, cyan, and black monochromatic images, respectively, and are aligned along the intermediary transfer belt 7.

In the image forming portion Sa, a yellow toner image is formed on a photosensitive drum 1*a*, and transferred onto the intermediary transfer belt 7. In the image forming portion Sb, a magenta toner image is formed on a photosensitive drum 1*b*, and is transferred onto the intermediary transfer belt 7. In the image forming portions Sc and Sb, a cyan toner image and a black toner image are formed on photosensitive drums 1*c* and 1*d*, respectively, and are transferred onto the intermediary transfer belt 7.

The intermediary transfer belt 7 is stretched and supported by first transfer rollers 5*a*, 5*b*, 5*c*, and 5*d*, a backup roller 8, a tension roller 17, and a tension roller 18, and is circularly driven in the direction indicated by an arrow mark R7 by the backup roller 8 which doubles as a belt driving roller. After the transfer of the four monochromatic toner images, different in color, onto the intermediary transfer belt 7, the four toner images are conveyed by the intermediary transfer belt 7 to the second transfer portion T2, in which they are transferred (second transfer) onto a sheet P of recording medium which was taken out of a recording sheet cassette 10 and conveyed to the second transfer portion T2. The sheet P of recording medium is supplied to the second transfer portion T2 by a sheet feeding-and-conveying apparatus which comprises a sheet feeding roller, sheet conveying roller, registration rollers, etc. (which are not shown in FIG. 1).

After the transfer of the toner images onto the sheet P of recording medium in the second transfer portion T2, the sheet P is conveyed to a fixing apparatus 13 which has a fixation roller 14 and a pressure roller 15, and is conveyed through the fixing apparatus 13. While the sheet P is conveyed through the fixing apparatus 13, the sheet P and the toner images thereon are subjected to heat and pressure by the fixation roller 14 and pressure roller 15 which are kept pressed upon each other. Thus, the toner images are fixed to the sheet P. Then, the sheet P is discharged from the image forming apparatus 200.

The image forming portions Sa, Sb, Sc, and Sd are roughly the same in structure, although they are different in the color of the toner they use. The developing apparatuses 100*a*, 100*b*, 100*c*, and 100*d* also are roughly the same in structure although they also are different in the color of the toner they use. Hereafter, therefore, only the image forming portion Sa is described. The description of the image forming portions Sb, Sc, and Sd are the same as that of the image forming portion Sa, except for the suffixes of the referential codes of the structural components.

The image forming portion Sa comprises: a photosensitive drum 1*a*; and a charge roller 2*a*, an exposing apparatus 3*a*, a developing apparatus 100*a*, first transfer roller 5*a*, and an auxiliary charge roller 6*a*, which are in the adjacencies of the peripheral surface of the photosensitive drum 1*a*.

The photosensitive drum 1*a* comprises: an aluminum cylinder; and a negatively chargeable photosensitive layer which covers virtually the entirety of the peripheral surface of the photosensitive drum 1*a*. The photosensitive drum 1*a* is rotated in the direction indicated by an arrow mark R1 at a preset peripheral velocity. The charge roller 2*a* uniformly charges the peripheral surface of the photosensitive drum 1*a* to the negative polarity. The exposing apparatus 3*a* writes an electrostatic image of the original to be formed, on the peripheral surface of the photosensitive drum 1*a* by scanning the uniformly charged portion of the peripheral surface of the photosensitive drum 1*a* with the beam of laser light it projects while reflecting the beam with a rotating mirror. The developing apparatus 100*a* forms a visible image formed of toner (which hereafter will be referred to simply as toner image) on the peripheral surface of the photosensitive drum 1*a*, by developing the electrostatic image on the peripheral surface of the photosensitive drum 1, with the use of two-component developer made up of toner and carrier.

The first transfer roller 5*a* is within the loop which the intermediary transfer belt 7 forms. It is kept against the peripheral surface of the photosensitive drum 1 with the presence of the intermediary transfer belt 7 between the first transfer roller 5*a* and photosensitive drum 1*a*, forming thereby the first transfer portion T1, between the peripheral surface of the photosensitive drum 1*a* and intermediary transfer belt 7. As positive DC voltage is applied to the first transfer roller 5*a*, the toner image on the peripheral surface of the photosensitive drum 1*a*, which is made of negatively charged toner particles, is transferred (first transfer) onto the intermediary transfer belt 7. The auxiliary charge roller 6*a* negatively charges the transfer residual toner particles in order to make the transfer residual toner contribute to the following development process to be carried out by the developing apparatus 100*a*. The transfer residual toner particles are the toner particles on the peripheral surface of the photosensitive drum 1*a*, which failed to be transferred onto the intermediary transfer belt 7, and therefore, remained on the peripheral surface of the photosensitive drum 1.

The image forming apparatus 200 is provided with a belt cleaner 11 for removing the transfer residual toner remaining adhered to the intermediary transfer belt 7. The belt cleaner 11 is positioned so that it opposes the tension roller 17 with the presence of the intermediary transfer belt 7 between the cleaner 11 and roller 17.

<Developing Apparatus>

Figure 2:
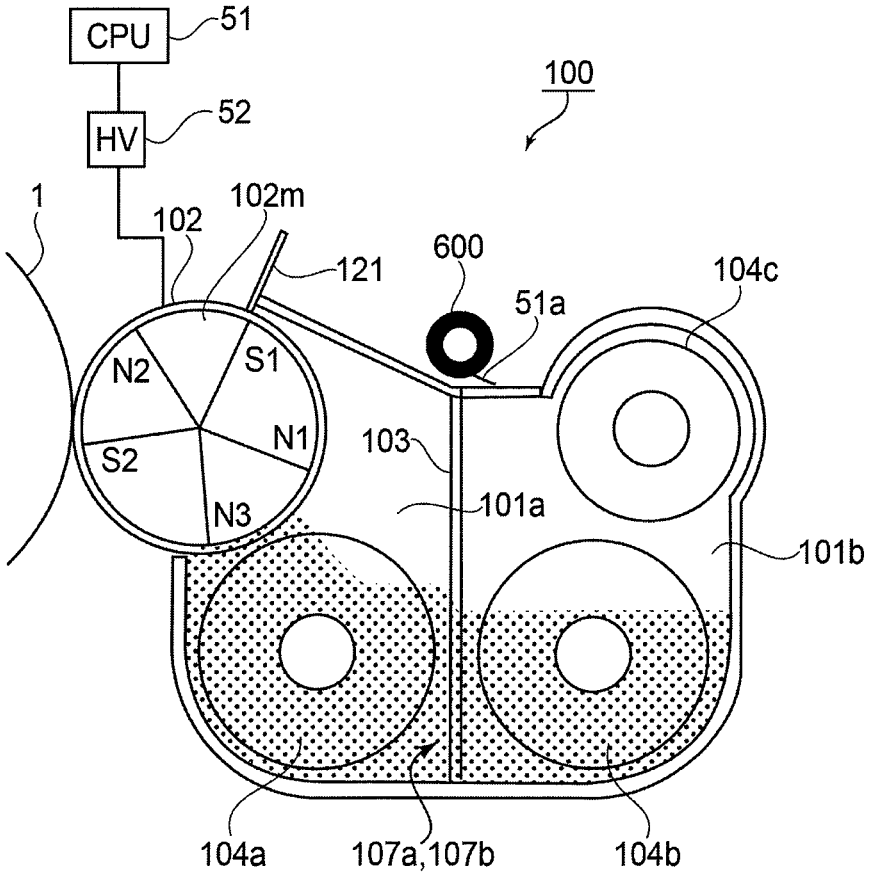
FIG. 2 is a schematic sectional view of the developing apparatus in the first preferred embodiment of the present invention, and is for describing the structure of the apparatus.
Figure 3:
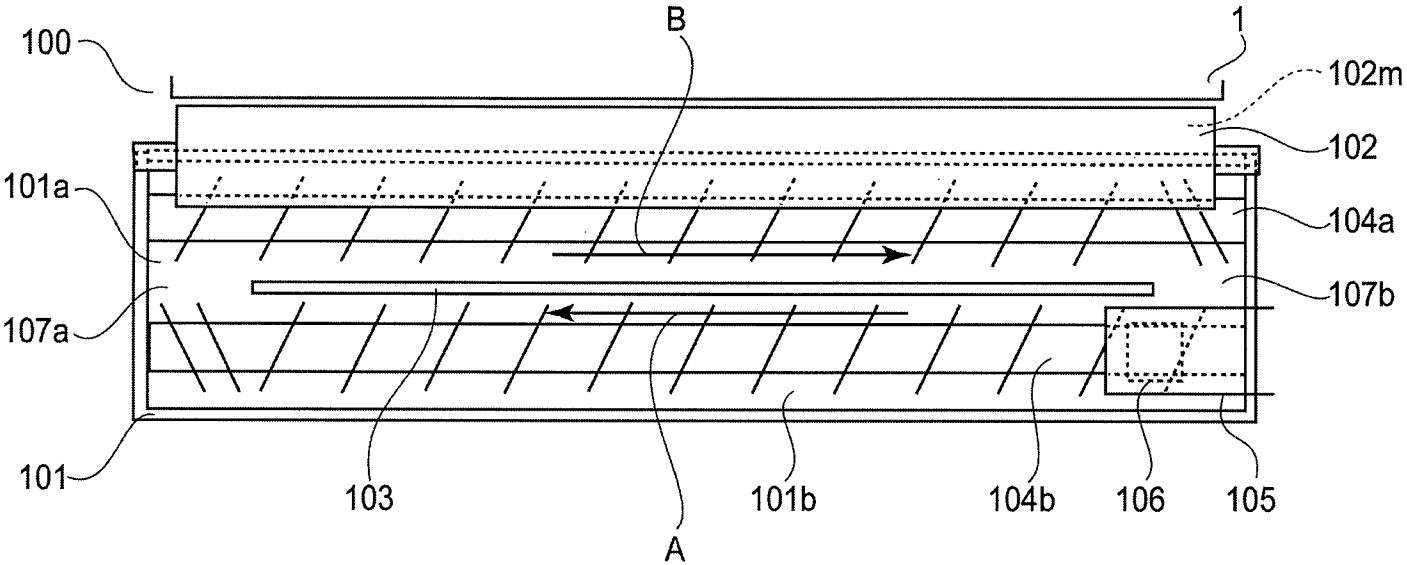
FIG. 3 is a partially phantom plan view of the developing apparatus in the first preferred embodiment of the present invention, and is also for describing the structure of the apparatus.

FIG. 2 is a schematic sectional view of the developing apparatus in this embodiment of the present invention, and is for describing the structure of the developing apparatus. FIG. 3 is a partially phantom plan view of the developing apparatus in this embodiment of the present invention, and is also for describing the structure of the apparatus. In the following description of the developing apparatus, the suffixes of the referential codes for the components of the developing apparatus and image forming apparatus, which indicate the differences among the four developing apparatuses and four image forming portions, in terms of the color of the toner they use, are omitted.

Referring to FIG. 2, the developing apparatus 100 has a development sleeve 102 as an example of a developer bearing member. It develops an electrostatic image on the photosensitive drum 1 by causing the development sleeve 102 to bear developer which is made up of toner and carrier. The developing apparatus 100 has a developing means container 101 (developing apparatus shell) which has an opening which faces the photosensitive drum 1. The development sleeve 102 is rotatable, and is positioned so that it contacts the peripheral surface of the photosensitive drum 1 through the opening of the developing apparatus shell 101. The developing apparatus has also a blade 121 for regulating in thickness the toner layer borne on the peripheral surface of the development sleeve 102. The blade 121 is on the upstream side of the development area in which the peripheral surface of the development sleeve 102 squarely faces the peripheral surface of the photosensitive drum 1.

The developing apparatus shell 101 has a development chamber 101*a* and a developer stirring chamber 101*b*, which are partitioned from each other by a vertical partition wall 103. Both the development chamber 101*a* and developer stirring chamber 101*b* contain two-component developer, that is, mixture of nonmagnetic toner, magnetic carrier, and a small amount of external additives.

The developing apparatus 100 has a stationary magnet 102*m* which has multiple magnetic poles. The magnet 102*m* is within the hollow of the development sleeve 102. The developer in the development chamber 101*a* is borne on the peripheral surface of the development sleeve 102 by being confined by the magnetic flux formed between the adjacent two magnetic poles of the magnet 102*m*, forming thereby a magnetic brush made up of positive charged carrier particles, and the negative charge toner particles which are electrostatically held to the surface of the carrier particles. An electric power source 52 is for transferring the negative charged toner particles in the magnetic brush, onto the electrostatic image on the photosensitive drum 1, by applying oscillatory voltage, that is, a combination of negative DC voltage, and AC voltage.

Referring to FIG. 3, the developing apparatus shell 101 has two parallel chambers, that is, the stirring chamber 101*b* and development chamber 101*a*, separated by the partition wall 103. The two chambers 101*a* and 101*b* are structured so that they can store two-component developer and also, so that the developer is conveyed through them. That is, the developing apparatus has: the stirring chamber 101*b* which contains a stirring screw 104*b*; development chamber 101*a* which contains a development screw 104*a*; and development sleeve 102, which is in the adjacencies of the development chamber 101*a*.

The partitioning wall 103 has openings 107*a* and 107*b*, which are at the lengthwise ends of the partitioning wall 103 in terms of the lengthwise direction of the developing apparatus 200. Thus, the development chamber 101*a*, opening 107*b*, stirring chamber 101*b*, and opening 107*a* form a passage through which developer can be circulated. That is, the developer in the stirring chamber 101*b* is moved into the development chamber 101*a* through the opening 107*a*, whereas the developer in the development chamber 101*a* is moved into the stirring chamber 101*b* through the opening 107*b*.

While the developer is circulated through the developer circulation path structured as described above, the developer becomes frictionally charged by being stirred. More specifically, the toner particles become negatively charged, whereas the carrier particles become positive charged. The developer in the stirring chamber 101*b* is conveyed toward the opening 107*a* while being stirred by the stirring screw 104*b*, and flows into the development chamber 101*a* through the opening 107*a* of the partitioning wall 103. Then, the developer in the development chamber 101*a* is borne on the peripheral surface of the development sleeve 102 as it is conveyed toward the opening 107*b* while being stirred by the development screw 104*a*.

The development screw 104*a*, which is an example of the first developer conveyance screw, is rotatably position in the development chamber 101*a*, which is an example of the first chamber. As the first stirring screw 104*a* is rotated, the two-component developer in the development chamber 101*a* is conveyed toward the opening 107*b* as indicated by an arrow mark B.

The stirring screw 104*b*, which is an example of the second developer conveyance screw, is rotatably positioned in the stirring chamber 101*b*, which is an example of the second chamber. As the second developer conveyance screw 104*b* is rotated, the two-component developer in the stirring chamber 101*b* is conveyed toward the opening 107*a* as indicated by an arrow mark A.

Figure 5:
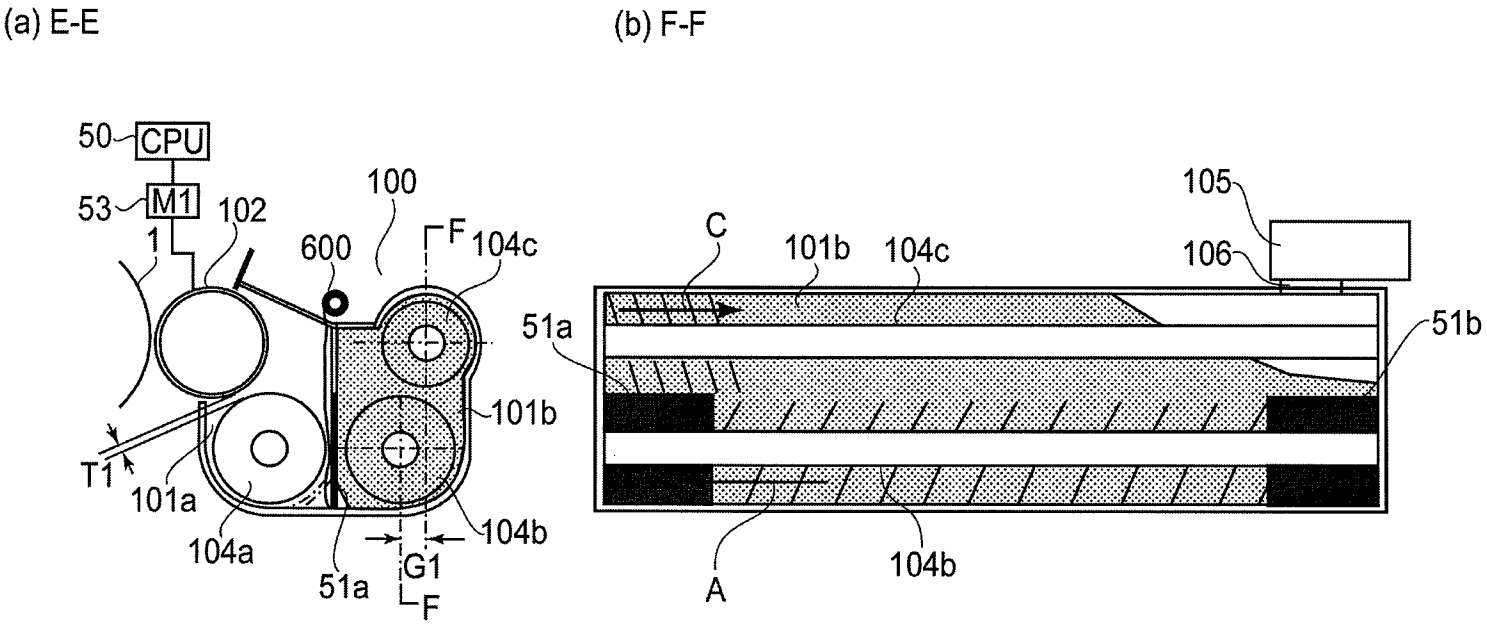
FIG. 5 is a drawing for describing the structural features of the developing apparatus in the first preferred embodiment of the present invention, which is for keeping the startup developer sealed in the developing apparatus.

There is a toner supplying mechanism 105, which is above the upstream end of the stirring chamber 101*b* in terms of the developer conveyance direction (FIG. 5(*b*)). The replenishment toner in an unshown toner bottle is delivered to the toner supplying mechanism 105 through an unshown toner delivery passage, and then, is let fall into the stirring chamber 101*b* through a toner replenishment opening 106. The replenishment toner is of the same type as the startup toner, that is, the toner which is used when a brand-new developing apparatus is used for the very first time.

The amount Q/M of the toner charge of the two-component developer is one of the primary parameters which determine the image density level to which an electrostatic image is developed. Further, there is a correlation between the weight ratio (density T/D of toner) of the toner in the two-component developer, and the amount Q/M of the toner charge.

Toner particles are charged by the friction between them and carrier particles. Therefore, the greater the frequency with which they come into contact with carrier particles, the greater the amount Q/M of the toner charge. Thus, the smaller the developer in the toner density T/D, the greater the amount Q/M of the toner charge, and therefore, the lower the developer in the image density level to which it develops an electrostatic image. Therefore, the toner density T/D of the developer is continuously monitored with an unshown magnetic permeability sensor as the developer is circulated through the development chamber 101*a* and stirring chamber 101*b*. Further, the amount by which the developing apparatus 100 is supplied with replenishment toner from the toner supplying mechanism 105 is adjusted so that the developer in the developing apparatus 100 remains roughly stable in the toner density T/D.

The two-component developer is a mixture of toner and carrier, which is preset in the toner density T/D as disclosed in Japanese Laid-open Patent Application 2001-249544. It remains sealed in the developer container. If the two-component developer is left unattended for a substantial length time in an ambience which is high is temperature and humidity, after the toner and carrier are mixed with each other, the average toner particle charge Q/M of the two-component developer remaining sealed in the developer container is lower than the preset value, when the developing apparatus 100 is started up.

As one of the means for dealing with the above described situation, it is possible to circulate the developer in the developing apparatus 100 through the development chamber 101*a* and stirring chamber 101*b* by the development screw 104*a* and stirring screw 104*b* until the toner charge amount Q/M of the developer reaches a proper value. However, continuous stirring of the developer sometimes causes the developer to deteriorate. For example, it sometimes reduces the developer in fluidity and/or rechargeability.

Thus, the length of time the developer is circulated in the developing apparatus 100 during the startup period of the developing apparatus is desired to be as short as possible. In this embodiment, therefore, such a method that the startup developer, that is, the developer which is used by the developing apparatus when the developing apparatus is used for the very first time, is kept sealed in a container independent from the developing apparatus, or the startup developer is kept sealed within the developing apparatus, is employed.

The method which supplies the developing apparatus with the startup developer from the container different from the developing apparatus shell is problematic in that when the developing apparatus is supplied with the startup developer, the developer is likely to scatter and contaminate the adjacencies of the developing apparatus. It is also problematic in that the length of time spent to supply the developing apparatus with the startup developer from the container other than the developing apparatus shell is wasted time; it reduces the developing apparatus in operability; it requires a certain amount of skill to supply the developing apparatus with the startup developer; and the like. Further, it is problematic in that when the developing apparatus is transported after it was supplied with the startup developer, the developer in the apparatus is liable to overflow or leak.

Therefore, having the startup developer hermetically sealed in the developing apparatus has been becoming mainstream (Japanese Laid-open Patent Applications 2001-75346, and 2002-236413). Further, Japanese Laid-open Patent Application 2004-252174 discloses a developing apparatus structured so that the startup developer remains sealed in the stirring chamber of the developing apparatus by sealing the openings of the partitioning wall with a sealing member.

<Structural Arrangement for Keeping Startup Developer Sealed>

Figure 4:
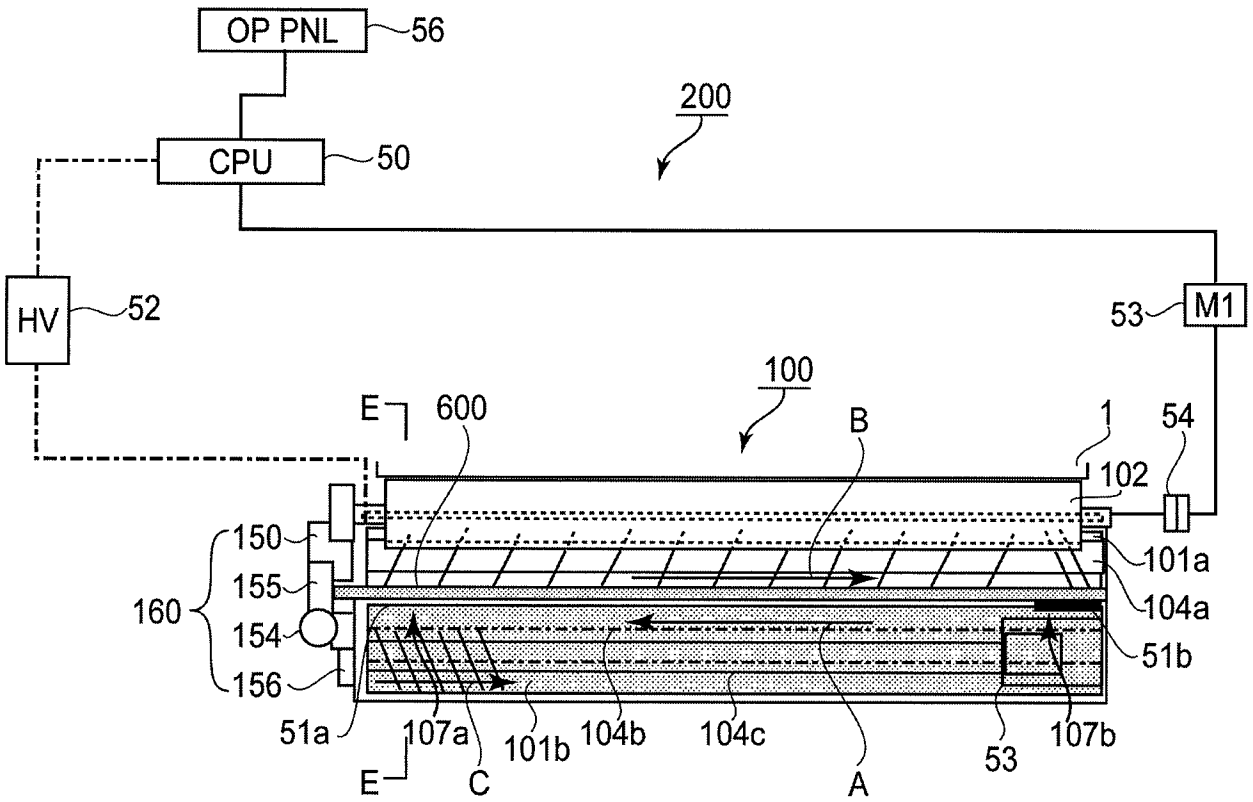
FIG. 4 is a partially phantom top plan view of the developing apparatus in the first preferred embodiment of the present invention, and is also for describing the structure of the apparatus.

FIG. 4 is a partially phantom top plan view of the developing apparatus in this embodiment of the present invention, and is for describing the structure of the apparatus. FIG. 5 is a drawing for describing the structural feature of the developing apparatus in this embodiment of the present invention, which is for keeping sealed the startup developer in the developing apparatus. FIG. 5(*a*) is a vertical sectional view of the developing apparatus at a plane E-E in FIG. 4, and FIG. 5(*b*) is a vertical sectional view of the developing apparatus at a plane F-F in FIG. 5(*a*).

Referring to FIG. 4, the relationship among the developing apparatus, motor 53, electric power source 52, control portion 50, and the control panel is shown in the form of a block diagram. The developing apparatus 100 is provided with a sealing sheet 51*a* and a sealing sheet 51*b*. The sealing sheet 51*a* is an example of a sealing member to be pasted to the surrounding edges of the opening 107*a* of the partitioning wall 103 which partitions the internal space of the developing apparatus 100. The sealing sheet 51*b* is an example of a sealing member to be pasted to the surrounding edge of the opening 107*b*. Since the developing apparatus is structured as described above, the startup developer remains sealed only in the stirring chamber 101*b* of the developing apparatus when the developing apparatus is shipped from a manufacturer. That is, when the developing apparatus is shipped from the manufacturer, neither the carrier nor toner of the developer is in the development chamber 101*a*.

Referring to FIG. 5(*a*), the sealing sheets 51*a* and 51*b*, which are examples of a sealing member, are pasted to the edge portions of the openings 107*a* and 107*b*, and can be peeled away. More specifically, the sealing sheet 51*a* is pasted to the edge portions of the opening 107*a*, that is, the downstream opening of the partitioning wall 103 in terms of the direction in which the developer is conveyed by the developer conveying second screw, whereas the sealing sheet 51*b* is pasted to the opening 107*b*, that is, the upstream opening of the partitioning wall 103.

The sealing sheet 51*a* is pasted to the edge portions of the opening 107*a* in such a manner that it extends from the top edge portion of the opening 107*a* to the bottom edge portion of the opening 107*a*, and is doubled back to the downstream end, at which it is solidly attached to a rotational take-up shaft 600. Similarly, the sealing sheet 51*b* is pasted to the edge portions of the opening 107*b* in such a manner that it extends from the downstream edge portion of the opening 107*b* to the upstream end portion of the opening 107*b*, and is doubled back to the downstream end, at which it is solidly attached to the rotational take-up shaft 600.

As the stirring screw 104*b* is rotated, the rotational take-up shaft 600, which is a part of a sealing member pealing mechanism, is rotated by the rotation of the stirring screw 104*b*, exposing the openings 107*a* and 107*b* by peeling the sealing sheets 51*a* and 51*b*. The image forming apparatus 200 and developing apparatus 100 are structured so that when a brand-new developing apparatus is used for the very first time, the rotational take-up shaft 600 automatically (that is, without being operated by user) peels away the sealing sheets 51*a* and 51*b* from the edge portions of the openings 107*a* and 107*b* to start up the developing apparatus for image formation.

Further, the developing apparatus 100 is structured so that the timing with which the sealing member 51*a* begins to be peeled away by the rotational take-up shaft 600, is different from that with which the sealing member 51*b* begins to be peeled away by the rotational take-up shaft 600, and also, the timing with which the peeling of the sealing member 51*a* by the rotational take-up shaft 600 ends is different from that with which the peeling of the sealing member 51*b* by the rotational take-up shaft 600 ends. More specifically, the timing with which the peeling of the sealing member 51*a* by the rotational take-up shaft 600 from the edge portions of the opening 107*a* begins is earlier than the timing with which the peeling of the sealing member 51*b* by the rotational take-up shaft 600 from the edge portion of the opening 107*b* begins. In other words, the portion of the sealing sheet 51*b*, one of the end portions of which is pasted to the bottom edge portion of the opening 107*b*, and the other end portion of which is attached to the rotational take-up shaft 600 is made to be longer than the portion of the sealing sheet 51*a*, which extends from the point of double-back to the rotational take-up shaft 600.

<Mechanism for Driving Take-Up Shaft>

Figure 6:
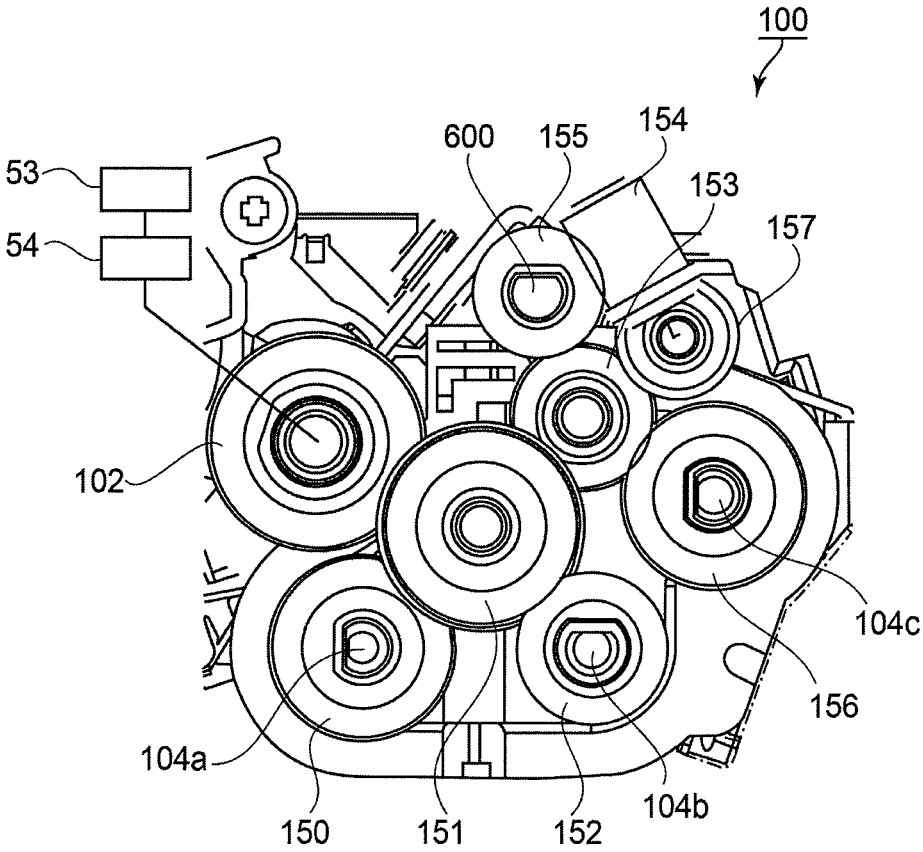
FIG. 6 is a drawing of the gear train of the developing apparatus in the first preferred embodiment of the present invention, and is for describing the gear train.

FIG. 6 is a drawing for describing the gear train of the developing cartridge 200. Referring to FIG. 6 along with FIG. 4, as the developing apparatus 100 is mounted into the main assembly of the image forming apparatus 200, the development sleeve 102 becomes connected to the motor 53 of the apparatus 200 through a coupling 54, which can be engaged or disengaged in the axial direction of the development sleeve 102. The motor 53 rotates the development sleeve 102 following the instructions from the control portion 50.

The mechanical force transmitted to the development sleeve 102 from the motor 53 rotates the stirring screw 104*b*, development screw 104*a*, rotational take-up shaft 600, and reverse conveyance screw 104*c* together, by being transmitted to them through a gear train 160, which is on the opposite side of the developing apparatus 100 from the side on which the motor 53 is connected to the development sleeve 102. The stirring screw 104*b*, development screw 104*a*, rotational take-up shaft 600, and reverse conveyance screw 104*c* are in connection to each other through the gear train 160. Thus, as the development sleeve 102 rotates, a center gear 151 rotates. A gear 150 which is in mesh with the gear 151 rotates the development screw 104*a*. A gear 152 which is in mesh with the gear 151 rotates the stirring screw 104*b*.

The reverse conveyance screw 104*c* is rotated by the driving force transmitted thereto through the gears 151, 153, and 156; the gear 153 is in mesh with the gear 151, and the gear 153 is in mesh with the gear 153. The rotational take-up shaft 600 is rotated by the driving force transmitted thereto through the gears 151, 153, 157, 154, and 155; the gear 153 is in mesh with the gears 151 and 157, and the gear 154 is in mesh with the gears 157 and 155. In order to ensure that the torque transmitted to the rotational take-up shaft 600 is large enough to efficiently peel away the sealing sheets 51*a* and 51*b*, a worm gear is employed as the gear 154 to cause the gear 154 to rotate substantially slower than the gear 154.

With the employment of the above described structural arrangement, the development sleeve 102, development screw 104*a*, and stirring screw 104*b* rotate at 250 rpm, 300 rpm, and 400 rpm, respectively. In order to make the stirring screw 104*b* higher in the developer charging performance than the development screw 104*a*, the stirring screw 104*b* is made higher in rotational speed than the development screw 104*a*. The reverse conveyance screw 104*c* and rotational take-up shaft 600 rotate at 300 rpm and 20 rpm, respectively.

Further, the developing apparatus 100 is structured so that the joint between the rotational take-up shaft 600 and gear 155 is in the adjacencies of the sealing sheet 51*a*. Thus, the sealing member which is farther from the lengthwise end portion of the rotational take-up shaft 600, by which the rotational take-up shaft 600 is driven, begins to be peeled later than the other sealing member.

Incidentally, in a case where the startup developer is kept hermetically sealed in the stirring chamber 101*b* by sealing the openings between the development chamber 101*a* and stirring chamber 101*b*, there is a problem that the amount of the load to which the motor 53 is subjected when the developing apparatus is started up is substantial. That is, if the rotation of the stirring screw 104*b* is continued without removing the sealing sheets 51*a* and 51*b*, the developer in the stirring chamber 101*b* cannot move into the development chamber 101*a*, and therefore, the amount of the force (torque) necessary to drive the developing apparatus 100 becomes very large.

In the case of the developing apparatus in this embodiment, as the developer in the stirring chamber 101*b* is moved by the rotation of the stirring screw 104*b*, into the downstream end portion of the chamber 101*b* when the opening 107*a* of the partitioning wall 103 is not exposed, the reverse conveyance screw 104*c*, which is an example of a means for conveying developer in the reverse direction, conveys the developer in the downstream end portion of the chamber 101*b*, (which was moved (packed) into the downstream end portion of the chamber 101*b* by the second conveyance screw (104*b*)), in the opposite direction from the direction in which the stirring screw 104*b* conveys the developer. The reverse conveyance screw 104*c* is positioned at such a height (relative to bottom of stirring chamber 101*b*) that after the formation of the developer recirculation path by exposing of the openings 107*a* and 107*b*, it will be above the developer recirculation path. The above described effect was confirmed by the experiments carried out by the inventors of the present invention, in which the reverse conveyance screw 104*c* was 15 mm in diameter, and no less than 9 mm in length.

<Control of Very First Startup>

Figure 7:
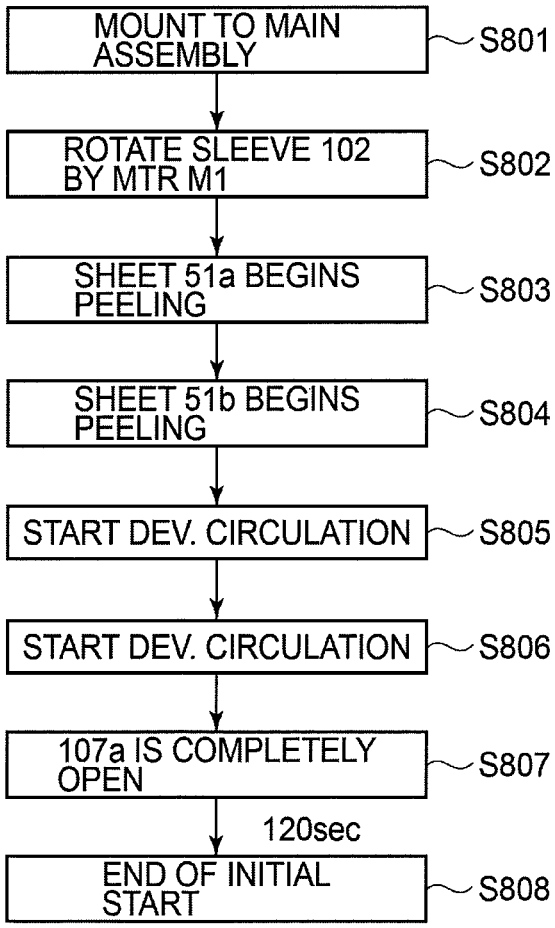
FIG. 7 is a flowchart of the startup sequence of the developing apparatus in the first preferred embodiment of the present invention.
Figure 8:
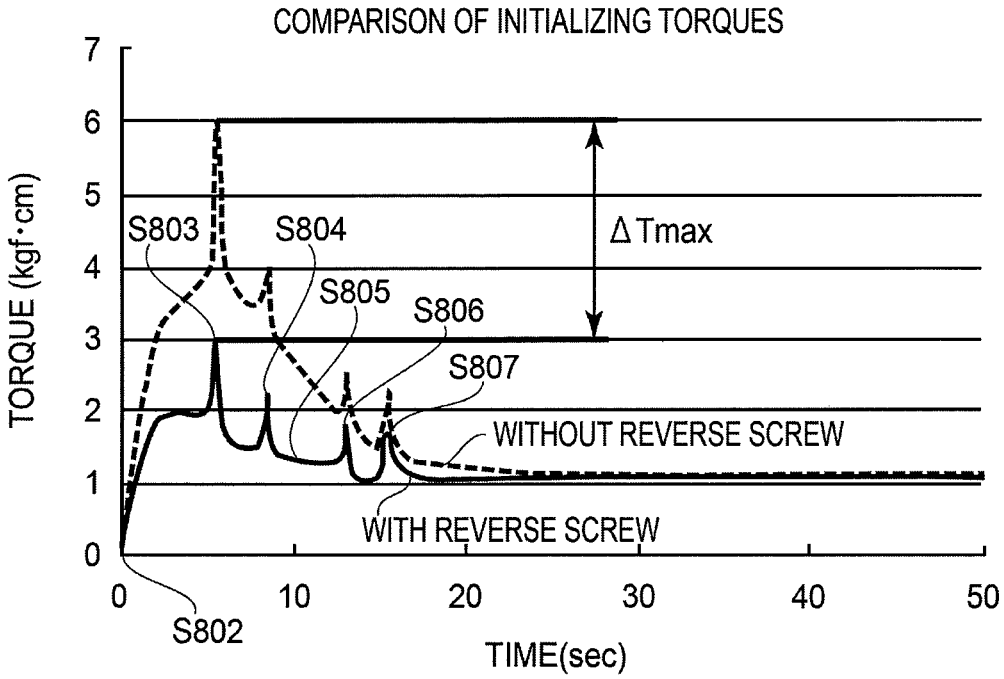
FIG. 8 is a graph which shows the relationship between the amount of torque required of the motor of the image forming apparatus, and the length of the elapsed time, when a brand-new developing apparatus in accordance with the present invention was started up.
Figure 9:
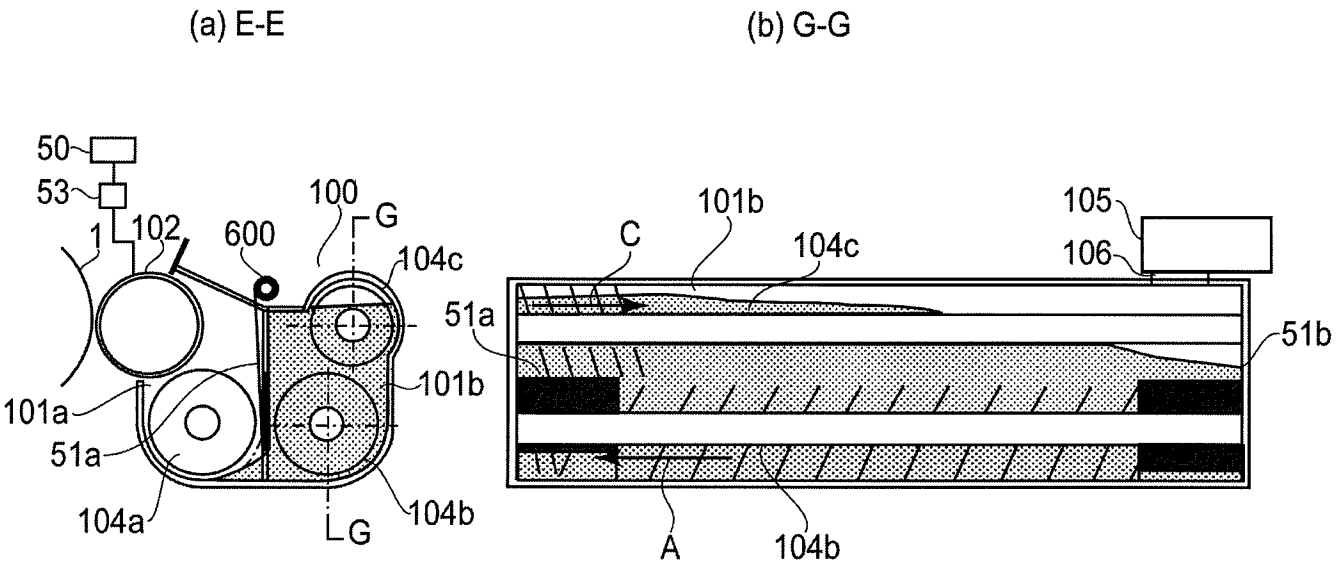
FIG. 9 is a drawing for describing the state of a brand-new developing apparatus right after the developing apparatus is started up for the very first time.
Figure 10:
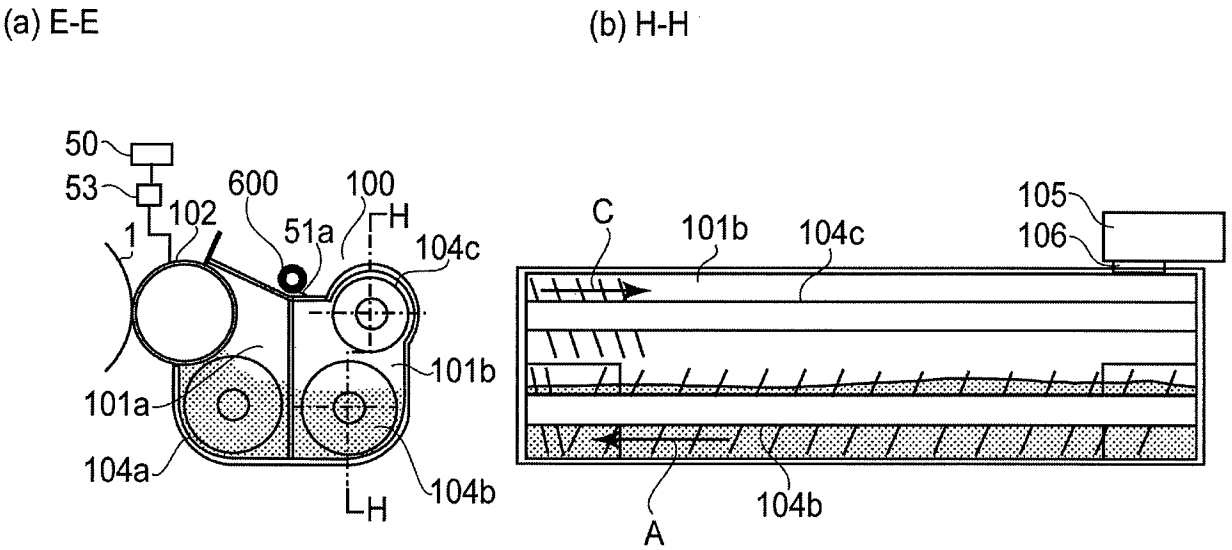
FIG. 10 is a drawing for describing the state of a brand-new developing apparatus after the startup developer began to be circulated through the development chamber and stirring chamber.

FIG. 7 is a flowchart of the control sequence carried out when a brand-new developing apparatus (100) is started up for the very first time. FIG. 8 is a graph which shows the relationship between the length of time having elapsed since the beginning of the startup operation, and the amount of torque required of the motor 53 of the image forming apparatus 200 to startup the developing apparatus for the very first time. FIG. 9 is a drawing of the developing apparatus 100 right after the sealing sheets began to be peeled. FIG. 10 is a drawing of the developing apparatus 100, which is for describing the circulation of the developer in the apparatus 100.

Unlike the sealing member(s) described in Japanese Laid-open Patent Application 2004-252174, the sealing members 51*a* and 51*b* of the developing apparatus 100 in this embodiment do not need to be manually removed by a user or service person. Instead, the sealing members 51*a* and 51*b* are automatically removed with the use of the motor 53 of the main assembly of the image forming apparatus 200. Thus, the developing apparatus 100 is significantly higher in usability than any of the developing apparatuses in accordance with the prior art.

Referring to FIG. 7 along with FIG. 4, first, the developing apparatus 100 is to be set in the image forming apparatus 200 by a user (S801).

Then, the user is to input a command for starting up the developing apparatus for the very first time, through a control panel 56. As the command is inputted, the control portion 50 begins to rotate the development sleeve 102 by activating the motor 53 with which the main assembly of the image forming apparatus 200 is provided. Thus, the stirring screw 104*b*, development screw 104*a*, reverse conveyance screw 104*c*, and rotational take-up shaft 600 begin to be rotated by the development sleeve 102, simultaneously with the development sleeve 102, by the rotation of the development sleeve 102 through the above described gear train 160 (S802).

Referring to FIG. 5(*b*), as the stirring screw 104*b* is rotated, the developer in the stirring chamber 101*b* is conveyed by the stirring screw 104*b* in the direction indicated by the arrow mark A. At this point in time, the sealing sheet 51*a* is yet to be peeled. Therefore, the developer in the stirring chamber 101*b* begins to collect in the downstream end portion of the stirring chamber 101*b* in terms of the direction of the arrow mark A (downstream side in terms of direction in which developer is conveyed by second conveyance screw in second chamber, opening of which is yet to be exposed). However, as the developer collects, it is conveyed in the direction indicated by an arrow mark C by the reverse conveyance screw 104*c*. Thus, the developer in the stirring chamber 101*b* circulates in the stirring chamber 101*b* as if the body of developer in the chamber 101*b* were separated into the top and bottom halves. Therefore, the amount of torque necessary to rotate the stirring screw 104*b* does not become excessive.

Referring to FIG. 5(*a*), even while the developer is circulated in the stirring chamber 101*b*, the sealing sheets 51*a* and 51*b* continue to be taken up (rolled up) on the rotational take-up roller 600 by the rotation of the roller 600. Since the doubled-back portion of the sealing sheet 51*a* is shorter than that of the sealing sheet 51*b*, that is, the sealing sheet 51*b* has a longer idle length or slack than the sealing sheet 51*a*. Therefore, the portion of the sealing sheet 51*a*, by which the sealing sheet 51*a* is pasted to the edge portions of the opening 107*a* of the partitioning wall 103, begins to be peeled before the portion of the sealing sheet 51*b*, by which the sealing sheet 51*b* is pasted to the edge portions of the opening 107*b* of the partitioning wall 103. Thus, the opening 107*a* becomes fully exposed before the opening 107*b* (S803).

Referring to FIG. 8, the amount of torque necessary to peel the sealing sheet 51*a* adds to the amount of torque necessary to rotate the abovementioned sleeves and rollers. Therefore, it is when the sealing sheet 51*a* begins to be peeled that the amount of torque required of the motor 53 becomes the maximum (S803). As the sealing sheet 51*a* is gradually peeled, the developer in the stirring chamber 101*b* begins to gradually leak into the development chamber 101*a* through the partially exposed opening 107*a*. However, while the partially exposed portion of the opening 107*a* is relatively small, the developer which is remaining in the stirring chamber 101*b* continues to be circulated within the stirring chamber 101*b* by the stirring screw 104*b* and reverse conveyance screw 104*c*.

As the sealing sheet 51*a* continues to be peeled, the amount by which the developer in the stirring chamber 101*b* is pushed into the development chamber 101*a* by the stirring screw 104*b* through the portion of the opening 107*a*, which is exposed by the peeling of the sealing sheet 51*a*, gradually increases. Thus, the developer pushed into the development chamber 101*a* by the stirring screw 104*b* from the stirring chamber 101*b* begins to be conveyed toward the opening 107*b* in the development chamber 101*a*.

Next, referring to FIG. 9, the portion of the sealing sheet 51*b*, by which the sealing sheet 51*b* is pasted to the edge portions of the opening 107*b*, begins to be peeled later than the portion of the sealing sheet 51*a*, by which the sealing sheet 51*a* is pasted to the edge portions of the opening 107*a* (S804). Thus, as the opening 107*b* begins to be exposed, the amount of torque required of the motor 53 to peel the sealing sheet 51*b* adds to the amount of torque which has been required of the motor 53, causing the amount of torque required of the motor 53 to peak for the second time (S804).

By the time the developer pushed into the development chamber 101*a* from the stirring chamber 101*b* is conveyed to the opening 107*b* by the development screw 104*a*, a substantial length of time will have elapsed since the sealing sheet 51*b* began to be peeled. Thus, as the developer in the development chamber 101*a* is conveyed by the development screw 104*a* to the portion of the development chamber 101*a*, which has the opening 107*b*, the developer flows into the stirring chamber 101*b* through the opening 107*b* without interference from the sealing sheet 51*b*. Then, the developer is picked up by the stirring screw 104*b*. This is when the developer begins to circulate throughout the developing apparatus 100 (S805).

As the sealing sheet 51*a* is peeled all the way, and the entirety of the sheet 51*a* is rolled up on the rotational take-up shaft 600, the opening 107*a* becomes fully exposed (S806). Slightly later, the sealing sheet 51*b* is completely rolled up on the rotational take-up shaft 600, and therefore, the opening 107*b* becomes fully exposed (S807).

After the full exposure of the openings 107*a* and 107*b*, the control portion 50 continues to rotate the development sleeve 102, development screw 104*a*, stirring screw 104*b*, and reverse conveyance screw 104*c* for 120 seconds, and then, stops them. Thus, the two-component developer in the developing apparatus shell becomes fully mixed by being stirred as shown in FIG. 10, and then, the very first startup of the developing apparatus is ended (S808). Incidentally, in a case where the above described very first startup of the developing apparatus 100 is carried out during an image forming operation, or after the inputting of an image formation start command, the control portion 50 restarts the interrupted image forming operation, or starts an image forming operation.

While the developing apparatus 100 is engaged in an operation, the reverse conveyance screw 104*c* and rotational take-up shaft 6000 continue to be rotated with the development sleeve 102, etc. However, after the very first startup of the developing apparatus 100, the reverse conveyance screw 104*c* rotates in an area which is spaced from the top surface of the powder of developer in the stirring chamber 101*b*, that is, the reverse conveyance screw 104*c* is disposed above and spaced from the normal level (top), during the image forming operation, of the developer powder in the stirring chamber 101*b* during the image forming operation, and the rotational take-up shaft 600 idly rotates bearing the sealing sheets 51*a* and 51*b*. Therefore, the amount of the torque required of the motor 53 to rotate the reverse conveyance screw 104*c* and rotational take-up shaft 600 is relatively small, and therefore, does not have adverse affect upon the rotation of the development sleeve 102 and the stirring of the developer.

<Comparative Developing Apparatus>

In the first preferred embodiment of the present invention described above, the reverse conveyance screw 104*c* is utilized during the very first startup of the brand-new developing apparatus. If a developing apparatus is not provided with the reverse conveyance screw 104*c*, the amount of torque required of the motor 53 when its sealing sheet 51*a* begins to be peeled becomes greater by Δtmax than that when the sealing sheet 51*a* of the developing apparatus in the first embodiment of the present invention begins to be peeled, as indicated by a broken line in FIG. 8. Thus, in the case of a developing apparatus with no reverse conveyance screw 104*c*, either the image forming apparatus 200 has to be provided with a motor (53) which is greater in capacity, or has to be provided with a motor which is independent from the from the motor 53, as the motor for driving the rotational take-up shaft 600. Thus, it is not desired to eliminate the reverse conveyance screw 104*c*.

Incidentally, as the method for keeping the startup developer hermetically sealed in the developing apparatus, it is possible to use a method, shown in FIG. 5(*a*), which is different from the one in the first embodiment. In the case of this method, the openings 107*a* and 107*b* are left exposed, and the first startup developer is kept sealed in the development chamber 101*a* and stirring chamber 101*b* with a single sealing sheet which is pasted to the developing apparatus shell in such a manner that it is between the development sleeve 102 and development screw 104*a*.

As long as the openings 107*a* and 107*b* are kept open to keep intact the developer circulation path in the developing apparatus, the continuous rotation of the developer conveyance screw 104*a* does not cause the phenomenon that the amount of the load to which the motor 50 is subjected to rotate the stirring screw 104*b* is increased by the pressure increase in a part of the body of developer in the stirring chamber 101*b*. Therefore, there is no need for the provision of the reverse conveyance screw 104*c*.

In this case, however, a space through which the sealing sheet can be passed has to be provided between the development sleeve 102 and development screw 104*a*. In other words, the space between the development sleeve 102 and development screw 104*a* has to be made larger than in the case of the first embodiment of the present invention, which is a problem. In the case of the developing apparatus in the first embodiment, the distance between the development sleeve 102 and development screw 104*a* was reduced to enable an image forming apparatus to output high quality images, and also, to prevent the developer therein from deteriorating. Thus, this comparative developing apparatus invites opposite effects from those of the developing apparatus in the first embodiment of the present invention.

Also in the case of the developing apparatus 100 in the first embodiment, the magnetic force of the magnet 102*m* in the development sleeve 102 is used to attract the developer to the peripheral surface of the development sleeve 102 and keep the developer borne thereon. Thus, unless the distance between the development sleeve 102 and development screw 104*a* is very small, the magnet 102*m* has to be replaced with a magnet which is substantially stronger in magnetism than the magnet 102*m*. This creates a problem in that the stronger the magnetic force to which the developer is subjected, the faster the developer deteriorates; the developer is reduced in durability.

Further, in order to improve the developing apparatus 100 (image forming apparatus 200) in image quality, it is desired to reduce the distance T1 between the development sleeve 102 and development screw 104*a* as much as possible. That is, in order to prevent the problem that the amount by which developer is supplied from the development screw 104*a* to the development sleeve 102 becomes insufficient, it is desired that the distance T1 is made as small as possible.

Regarding this matter, if it is necessary to place a sealing sheet between the development sleeve 102 and development screw 104*a*, the distance T1 cannot be reduced as much as it can be if it is unnecessary to place a sealing sheet between the development sleeve 102 and development screw 104*a*. Further, it is possible that the development sleeve 102 may be damaged when the sealing sheet is peeled away.

<Effects of First Preferred Embodiment>

Referring to FIG. 5(*b*), in the first embodiment, the reverse conveyance screw 104*c* is placed so that it is above the stirring screw 104*b*, and also, so that in terms of the direction perpendicular to the lengthwise direction of the developing apparatus, the center shaft of the reverse conveyance screw 104*c* is offset rearward from the center shaft of the stirring screw 104*b* by a distance G1. Therefore, not only is a sufficient amount of clearance secured between the top portion of the stirring screw 104*b*, and the rotational take-up shaft 600, but also, the reverse conveyance screw 104*c* is not in contact with the developer immediately after the completion of the very first startup of the developing apparatus 100.

Also in the first embodiment, in order to make it easier to roll up the sealing sheets 51*a* and 51*b* on the rotational take-up shaft 600, thin sheets (0.1 mm in thickness) of resin (which includes polyester) was used as the material for the sealing sheets 51*a* and 51*b*. This material is basically the same as that used as the material for the sealing sheet, disclosed in Japanese Laid-open Patent Application 2002-236413, which is to be manually peeled. Incidentally, the material and shape of the sealing sheet, and the timing with which the sealing sheet is to be peeled, do not need to be limited to those described above.

The amount of load to which the motor 53 is subjected to peel the sealing sheets 51*a* and 51*b* is likely to be higher at the beginning and end of the peeling. In this embodiment, therefore, even though the two sealing sheets are peeled together, the two sealing sheets 51*a* and 51*b* are made different in the peeling starting timing as well as the peeling ending timing. Thus, the point in time at which the amount of load to which the motor 53 is subjected peaks while the sealing sheet 51*a* is peeled does not coincide with the timing with which the sealing sheet 51*b* is peeled. Therefore, the developing apparatus 100 in this embodiment is significantly smaller than any of the developing apparatuses in accordance with the prior art, in terms of the maximum amount of load to which the motor 53 is subjected when the sealing sheets are peeled.

Further, in this embodiment, the points in time at which the amount of load to which the motor 53 is subjected peaks while the sealing sheets 51*a* and 51*b* are peeled are adjusted by making the doubled-back portion of the sealing sheet 51*b* longer than that of the sealing sheet 51*a*. However, the timing with which the peeling of the sealing sheet 51*a* begins or ends may be made different from the timing with which the peeling of the sealing sheet 51*b* begins or ends, by making the portion of the rotational take-up shaft 600, on which the sealing sheet 51*a* is rolled, different in diameter from the portion of the rotational take-up shaft 600, on which the sealing sheet 51*b* is rolled.

Further, if the amount of load to which the rotational take-up shaft 600 is subjected while the sealing sheets 51*a* and 51*b* are peeled exceeds a certain value, the rotational take-up shaft 600 is likely to be twisted in its rotational direction, in such a manner that the farther a given point of the rotational take-up shaft 600 is from the point of the driving force input, the later it is in the timing with which it begins to take up the sealing sheets.

In the first embodiment, therefore, the developing apparatus 100 is structured so that the point of connection between the gear 155 and rotational take-up shaft 600 is positioned in the adjacencies of the sealing sheet 51*a*, which is the first of the sealing sheets 51*a* and 51*b* that begins to be peeled. Therefore, it is ensured that even if the rotational take-up shaft 600 becomes twisted, the sealing sheet 51*b* always begins to be peeled after the sealing sheet 51*a* begins. Thus, it is ensured that even if the rotational take-up shaft 600 is low in rigidity, the sealing sheet 51*b* always begins to be peeled before the sealing sheet 51*a* begins. In other words, not only is the first embodiment applicable to a developing apparatus, the rotational take-up roller 600 of which is formed of a highly rigid material such as metal, but also, a developing apparatus, the rotational take-up roller 600 of which is made of a material, such as resin, which is relatively low in rigidity.

Also in the first embodiment, no sealing sheet is necessary between the development sleeve 102 and development screw 104*a* as mentioned in the description of the comparative developing apparatus. Thus, the distance T1 is only 2 mm, as shown in FIG. 5(*a*). That is, the distance T1 between the development sleeve 102 and development screw 104*a* may be made very small. Therefore, not only does the developing apparatus in this embodiment not scatter toner when the developing apparatus is started up for the very first time, but also, it improves an image forming apparatus in image quality. Further, it does not suffer from the problem that the development sleeve 102 is damaged by the peeling of the sealing sheets.

Further, in this embodiment, the developer in the development chamber 101*a* is attracted to the development sleeve 102 by the magnetic force of the magnet 102*m* in the development sleeve 102. Thus, the magnet 102*m* may be reduced in magnetic force by reducing the distance T1.

Conventionally, when the distance T1 was 2.5 mm, the magnetic force of the pole of the magnet which attracts the developer in the development chamber 101*a* to the development sleeve 102 was 600 G. However, in this embodiment, the distance 51 is only 2 mm. Therefore, the toner attracting pole of the magnet 102*m* may be no more than 500 G. In other words, this embodiment makes it possible to minimize the amount of developer deterioration by reducing the effect of the magnetism upon the developer by reducing the magnet 102*m* in magnetic force.

As the developer in the developing apparatus in an image forming apparatus deteriorates, the image forming apparatus begins to output foggy images. In the first embodiment, therefore, the deterioration of developer is minimized by the employment of the magnet 102*m*, which is significantly weaker in magnetic force than any of the conventional magnets for developer attraction. Therefore, not only is the developing apparatus in this embodiment unlikely to allow toner to scatter, but also, it prevents an image forming apparatus from outputting foggy images, the fogginess of which is attributable to the developer deterioration. Therefore, it enables an image forming apparatus to output high quality images for a long period of time.

<Embodiment 2>

Referring to FIG. 2, each time the developing apparatus is started up, its development sleeve 102 immediately begins to rotate, whereby the developer in the development chamber 101*a* is borne on the development sleeve 102. Right after the developer begins to be borne on the development sleeve 102, the developer in the development chamber 101*a* has been hardly charged. Therefore, the amount by which the toner adheres to the magnetic brush formed of the carried borne on the peripheral surface of the development sleeve 102 is not much. In reality, however, a small amount of toner is in the magnetic brush formed of carrier. Therefore, as the development sleeve 102 is rotated, toner sometimes scatters from the development sleeve 102.

Next, referring to FIG. 1, the developing apparatus 100 is provided with auxiliary charge rollers 6*a*, 6*b*, 6*c*, and 6*d*, which are examples of auxiliary charging means and are intended to reuse the transfer residual toner. In the case of a developing apparatus, such as the one in the second embodiment, which is provided with an auxiliary charging means (or auxiliary charging means) instead of a cleaning means, the auxiliary charge roller and primary charge roller have to be prevented from being contaminated with the transfer residual toner. Therefore, the developing apparatus 100 has to be increased in transfer efficiency to reduce the amount by which toner fails to be transferred. As a means for improving a developing apparatus (image forming apparatus) in transfer efficiency, it is effective to keep the amount Q/M of toner charge at a proper level. In other words, in order to prevent the auxiliary charge roller and primary charge roller from being contaminated with the transfer residual toner, the amount Q/M of toner charge has to be kept at a proper level.

Therefore, in the case of the developing apparatus 100 in this embodiment, when it is started up for the very first time, the startup developer in the developing apparatus 100 is stirred, while being kept confined in the stirring chamber 101*b*, in order to charge the developer to a certain potential level. Then, after the developer has been charged to a desired potential level, the developer is supplied to the development chamber 101*a*. More specifically, the startup developer is increased in the amount Q/M of toner charge by circulating the developer in the stirring chamber 101*b* while stirring the developer by the stirring screw 104*b* and reverse conveyance screw 104*c*, with the openings 107*a* and 107*b* kept sealed by the sealing sheets 51*a* and 51*b*.

That is, in the development chamber 101*a*, which is an example of the first chamber, the developer can be conveyed by the development screw 104*a*, which is an example of the first developer conveyance screw, along the development sleeve 102, which is an example of a developer bearing member, whereas in the stirring chamber 101*b* which is an example of the second chamber and is in connection to the development chamber 101*a*, the developer can be conveyed by the stirring screw 104*b*, which is an example of the second developer conveyance screw, in the opposite direction from the direction in which the developer is conveyed in the development chamber 101*a*.

Further, the sealing sheet 51*a* which is an example of a sealing member, keeps sealed in an unsealable manner, the opening 107*a*, which is on the downstream end of the developing apparatus in terms of the developer conveyance direction of the second developer conveyance screw. The rotational take-up shaft 600, which is an example of a sealing member removing mechanism, exposes the opening 107*a* by removing the sealing sheet 51*a*.

Further, in the stirring chamber 101*b*, the reverse conveyance screw 104*c*, which is an example of a means for conveying the developer in the reverse direction, conveys the developer in the opposite direction from the direction in which the developer is conveyed by the second developer conveyance screw, while the opening 107*a* is kept sealed. Thus, the reverse conveyance screw 104*c* can circulate the developer in the stirring chamber 101*b*, while stirring the developer, in coordination with the stirring screw 104*b*.

As for the control portion 50 which is an example of a controlling means, it executes such a control that, first, the startup developer which has been kept confined in the stirring chamber 101*b* by keeping the opening 107*a* sealed with the sealing sheet 51*a* is circulated, while being stirred, by the stirring screw 104*b* and reverse conveyance screw 104*c*, and then, the opening 107*a* is exposed by the control of the rotational take-up roller 600 to circulate the developer through the development chamber 101*a* and stirring chamber 101*b*.

In other words, right after the developing apparatus 100 is started up for the very first time, the development chamber 101*a* remains empty, and therefore, no developer is borne on the development sleeve 102 no matter how many times the development sleeve 102 rotates. That is, until the sealing sheet 51*a* is peeled, the startup developer is continuously charged by being circulated in the stirring chamber 101*b* by the stirring screw 104*b* and reverse conveyance screw 104*c* along the stirring screw 104*b* and reverse conveyance screw 104*c*. Then, as soon as the opening 107*a* is unsealed, the fully charged developer in the stirring chamber 101*b* flows into the development chamber 101*a*. Then, as the body of the developer in the development chamber 101*a* becomes large enough for its top surface to reach the development sleeve 102, the developer is borne on the development sleeve 102. Therefore, even right after the completion of the startup operation of a brand-new developing apparatus, the amount Q/M of toner charge is at a proper level. Therefore, the problem that an image forming apparatus outputs low quality images, the low quality of which is attributable to the scattering of toner which occurs during the initial startup of a brand-new developing apparatus, contamination of the charge roller(s), and the like, is prevented.

<Embodiment 3>

Even though the present invention was described with reference to the developing apparatus which is removably mountable in an image forming apparatus, it is also applicable to a developing apparatus which is in the form of a process cartridge. With the application of the present invention to a developing apparatus in the form of a process cartridge, it is possible to realize a development cartridge which does not scatter toner, is maintenance-free, and is high in usability.

In the case of a developing apparatus in accordance with the present invention, the second chamber is provided with a developer conveying means which conveys the developer in the second chamber in the opposite direction from the direction in which the developer is conveyed by the second developer conveyance screw. Therefore, the developer in the second chamber is prevented from accumulating in the downstream end of the second chamber in terms of the developer conveyance direction of the second developer conveyance screw. Therefore, even if the second developer conveyance screw continues to rotate, the increase in the amount of the developer pressure in the downstream end portion of the second chamber in terms of the developer conveyance direction of the second developer conveyance screw remains relatively low. Therefore, the amount of torque necessary to drive the second developer conveyance screw does not excessively increase.

Therefore, the developing apparatus driving motor of an image forming apparatus is not overloaded while the sealing sheets of a developing apparatus shipped from a manufacturer, with the openings of its partitioning wall kept sealed with sealing sheets, are automatically removed by a rotational means for taking up the sealing sheets.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 115327/2010 filed May 19, 2010 which is hereby incorporated by reference.

What is claimed is:

1. A developing device comprising:

a developer carrying member for carrying a developer;

a first chamber, for supplying the developer to said developer carrying member, wherein said developer carrying member is partly exposed to said first chamber;

a first feeding member, rotatably provided in said first chamber, for feeding the developer;

a second chamber connected with said first chamber so as to establish a circulation path through a first communication opening and a second communication opening;

a second feeding member, rotatably provided in said second chamber, for feeding the developer in a direction opposite a feeding direction of the first feeding member;

a sealing portion for openably sealing said first communication opening and said second communication opening so as to confine the developer in said second chamber;

a moving mechanism for moving said sealing portion to unseal said first and second communication openings; and a third feeding member rotatably provided in said second chamber, for feeding the developer in a direction opposite the feeding direction of said second feeding member.

2. A device according to claim 1, wherein said third feeding member is provided above said second feeding member.

3. A device according to claim 1, wherein said third feeding member is positioned such that when said sealing portion seals said first and second communication openings, at least a part of said third feeding member is lower than a level of the developer in said second chamber, and in a normal image forming operation, said third feeding member is higher than the level of the developer sealed in said second chamber.

4. A device according to claim 1, wherein said moving mechanism includes a shaft, parallel with a rotational axis direction of the developer carrying member, for winding up said sealing portion, and wherein said first communication opening is disposed in a downstream side with respect to the feeding direction in said second chamber, and said moving mechanism unseals said first communication opening earlier than said second communication opening.

5. A developing device comprising:

a developer carrying member for carrying a developer;

a first chamber for supplying the developer to said developer carrying member, wherein said developer carrying member is partly exposed to said first chamber;

a first feeding member, rotatably provided in said first chamber, for feeding the developer;

a second chamber connected with said first chamber so as to establish a circulation path through a first communication opening and a second communication opening;

a second feeding member, rotatably provided in said second chamber, for feeding the developer in a direction opposite a feeding direction of the first feeding member;

a sealing portion for openably sealing said first communication opening and said second communication opening so as to confine the developer in said second chamber;

a moving mechanism for moving said sealing portion to unseal said first and second communication openings; and a third feeding member rotatably provided in said second chamber, for feeding the developer in a direction opposite the feeding direction of said second feeding member;

a single driving source for driving said second feeding member, said third feeding member and said moving mechanism;

wherein said second feeding member and said third feeding member are driven by said driving source during an unsealing operation of said sealing portion.

6. A device according to claim 5, wherein said third feeding member is provided above said second feeding member.

7. A device according to claim 5, wherein said third feeding member is positioned such that when said sealing portion seals said first and second communication openings, at least a part of said third feeding member is lower than a level of the developer in said second chamber, and in a normal image forming operation, said third feeding member is higher than the level of the developer sealed in said second chamber.

* * * * *